US008141803B2

(12) United States Patent
Hanghöj et al.

(10) Patent No.: US 8,141,803 B2
(45) Date of Patent: Mar. 27, 2012

(54) ROLLER MILL FOR GRINDING PARTICULATE MATERIAL

(75) Inventors: Sören Hanghöj, Köpenhamn Ö (DK); Morten Olsen, Copenhagen (DK)

(73) Assignee: FLSmidth A/S, Valby (DK)

( * ) Notice: Subject to any disclaimer, the term of this patent is extended or adjusted under 35 U.S.C. 154(b) by 167 days.

(21) Appl. No.: 12/665,628

(22) PCT Filed: Jul. 4, 2007

(86) PCT No.: PCT/EP2007/056769

§ 371 (c)(1), (2), (4) Date: Dec. 18, 2009

(87) PCT Pub. No.: WO2009/003527

PCT Pub. Date: Jan. 8, 2009

(65) Prior Publication Data

US 2010/0181401 A1 Jul. 22, 2010

(51) Int. Cl.
*B02C 9/04* (2006.01)
*B02C 19/00* (2006.01)

(52) U.S. Cl. ..... 241/117; 241/121

(58) Field of Classification Search ..... 241/117, 241/121

See application file for complete search history.

(56) References Cited

U.S. PATENT DOCUMENTS 4,181,264 A * 1/1980 Halloran, Jr. ..... 241/117
4,529,136 A * 7/1985 Gelbar ..... 241/79
4,717,082 A * 1/1988 Guido et al. ..... 241/121
4,765,755 A 8/1988 Kirkland
4,828,189 A * 5/1989 Schonbach ..... 241/121
4,989,795 A * 2/1991 de Lackner ..... 241/117
5,538,192 A * 7/1996 Parham ..... 241/30
7,028,934 B2 * 4/2006 Burynski et al. ..... 241/121
7,690,590 B2 * 4/2010 Nelson et al. ..... 241/30

FOREIGN PATENT DOCUMENTS

GB 601299 5/1948
JP 2002224581 8/2002
JP 20032251206 9/2003

* cited by examiner

*Primary Examiner* — Bena Miller
(74) *Attorney, Agent, or Firm* — Buchanan Ingersoll & Rooney PC

(57) ABSTRACT

A roller mill (1) for grinding particulate material such as cement raw materials, cement clinker, coal and similar materials, said roller mill (1) comprising a substantially horizontal grinding table (3) and a set of rollers revolving about a vertical shaft (5);

said set of rollers comprising a number of rollers (4) rotatable about respective roller axes and being connected via a roller bearing (16) and a roller shaft (6) to the vertical shaft (5), and said set of rollers (4) being configured for interactive operation with the grinding table (3) for application of pressure to the particulate material;

characterized in that each roller bearing (16) across its entire axial extent is axially located radially towards the vertical shaft (5) inwardly of the location of the resulting force from the grinding zone imposed upon the respective roller, in use.

20 Claims, 2 Drawing Sheets

ROLLER MILL FOR GRINDING PARTICULATE MATERIAL

CROSS-REFERENCE TO RELATED APPLICATIONS

This application is the United States national phase under 35 U.S.C. §371 of International Application No. PCT/EP2007/056769, filed on Jul. 4, 2007. The entirety of International Application No. PCT/EP2007/056769 is incorporated by reference herein.

BACKGROUND OF THE INVENTION

1. Field of the Invention

The present invention relates to a roller mill for grinding particulate material such as cement raw materials, cement clinker, coal and similar materials, said roller mill comprising a substantially horizontal grinding table and a set of rollers rotating about a vertical shaft, said set of rollers comprising a number of rollers rotatable about separate roller axes and being connected via a roller bearing and a roller shaft to the vertical shaft, and said set of rollers being configured for interactive operation with the grinding table for application of pressure to the particulate material.

2. Background of the Art

A roller mill of the aforementioned kind is known, for example, from the UK patent No. 601,299. This known mill is designed so that the set of rollers rotate in one direction and so that the grinding table rotates in the opposite direction so as to increase the capacity of the mill. According to the above-mentioned patent publication, the rollers are connected to the vertical shaft via a crank-like connection where each roller is supported by a stationary crank which protrudes centrally into the roller. In the publication there is no detailed mention about how the roller is supported on the crank, but based on previous knowledge of roller mills this is most likely achieved either by means of a slide bearing or a rolling bearing provided in the roller itself. With reference to FIG. 1, and as defined in the introduction, the roller bearing for each roller is influenced, during the operation of a roller mill, by the reactions $F_{g,1}$ and $F_{g,2}$ from the grinding force $F_g$ which occurs in the grinding zone between the roller and the grinding table. Also a gyro moment $M_{gyro}$ will be generated about the centre of mass of each roller in the plane containing the centre axis of the roller, said gyro moment will result in the reaction forces $F_{gyro,1}$ and $F_{gyro,2}$ on the roller bearing. The magnitude of this gyro moment and hence of the reaction forces depend on the moment of inertia of the roller and its rotational speed about its separate roller shaft and on the rotational speed of the set of rollers about the vertical shaft. As is apparent from FIG. 1, the innermost part of the bearing, i.e. that part of the bearing which is located closest to the vertical centre shaft will be unilaterally impacted by the reaction force $F_{gyro,2}$ and by a reaction contribution $F_{g,2}$ from the grinding force. Hence, the total load imposed upon this part of the bearing may be quite substantial, resulting in early-stage wearing-down and/or breakdown of the bearing.

BRIEF SUMMARY OF THE INVENTION

It is the object of the present invention to provide a roller mill by means of which the aforementioned disadvantage is reduced.

This is obtained by means of a roller mill of the kind mentioned in the introduction and being characterized in that each roller bearing across its entire axial extent is axially located radially towards the vertical shaft inwardly of the location of the resulting force from the grinding zone imposed upon the respective roller, in use.

As a result, the load incurred by the entire bearing and in particular by the innermost part hereof will be reduced since the reaction forces from the gyro moment and the grinding force will have a partial and mutually neutralizing effect across the entire axial extent of the bearing.

In principle, the roller bearing may be constituted by any suitable bearing and in a simple embodiment it may be constituted by a slide bearing which for example is formed as a bearing housing with a circular-cylindrical bearing shell in which the roller shaft is turning. However, it is preferred that the roller bearing is formed as a bearing housing comprising at least two rolling bearings. It is further preferred that the roller bearing comprises an axial bearing.

Each roller shaft is preferably connected to the vertical shaft via a hinged connection with a centre of rotation allowing a free arcuate movement in upward and downward direction in a plane comprising the centreline of the roller shaft. This will cause the gyro moment to contribute to the grinding force acting upon the particulate material. The plane in which the roller moves does not necessarily include the centreline of the vertical shaft. To obtain a minor sliding or shearing effect in the grinding zone the roller is sometimes or quite often slightly angled, meaning that its centreline does not always pass through the centreline of the vertical shaft. As is the case in previously known roller mills, the roller shaft itself may be stationary but in order to ensure maximum contribution to the grinding force from the gyro moment, it is preferred that the roller shaft is fixedly attached to the roller.

It is further preferred that the centre of rotation of the hinged connection in a vertical plane is located under the horizontal plane which comprises the centre of mass of the roller, roller shaft and the hinge part connected thereto so that the centrifugal force acting upon these machine parts during the operation of the mill will generate a turning moment about the hinge and hence a force which is directed downward against the grinding table.

In principle, the roller mill may be formed with inclined roller shafts, e.g. with an inclination between 0° and 45° to the horizontal level, so that, in accordance with the aforementioned, the centrifugal force acting upon each roller will positively contribute towards the grinding pressure when the centre of rotation of the hinged connection is located under the horizontal plane which comprises the centre of mass of the roller, the roller shaft and the hinge part connected thereto. However, the drawback associated with inclined roller shafts is that the force contributed by the gyroscopic effect is reduced. It is therefore preferred that the roller shaft for each roller is substantially horizontal.

BRIEF DESCRIPTION OF THE SEVERAL VIEWS OF THE DRAWINGS

The invention will now be explained in further details with reference to the drawing, being diagrammatical, and where

In FIG. 1 to FIG. 4 of the drawings, the same reference designations are used for corresponding parts. In all four figures a sectional view is given of a roller mill 1 which comprises a horizontal grinding table 3 and a set of rollers 4 operating interactively therewith, with only one of these rollers actually shown, and being connected to and rotating about a vertical shaft 5.

DETAILED DESCRIPTION OF THE INVENTION

Figure 1:
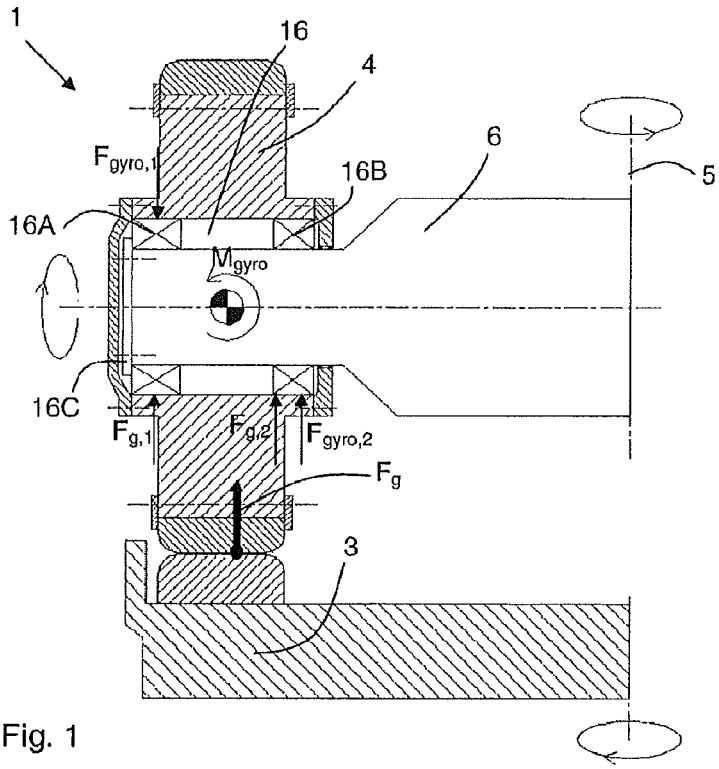
PRIOR ART Fig. 1
FIG. 1 shows a sectional view of a known roller mill.

In the roller mill shown in FIG. 1, the rollers 4 are supported on each horizontal roller shaft by means of a bearing 16 comprising two rolling bearings 16A and 16B which are axially positioned on separate sides in relation to the resulting grinding force $F_g$ from the grinding zone which acts upon the roller. As is apparent from FIG. 1, the rolling bearings 16A and 16B will during the operation of the roller mill be influenced by the reactions $F_{g,1}$ and $F_{g,2}$ from the grinding force $F_g$ which occurs in the grinding zone between the roller and the grinding table, and by the reaction forces $F_{gyro,1}$ and $F_{gyro,2}$ resulting from the gyro moment $M_{gyro}$ acting about the centre of mass of the roller. As is seen in FIG. 1, the rolling bearing 16B is unilaterally loaded by the reaction force $F_{gyro,2}$ and by the reaction contribution $F_{g,2}$ from the grinding force which is undesirable since this may cause the total load incurred by this bearing to be quite significant, entailing early-stage wearing-out and/or breakdown of the bearing.

Figure 2:
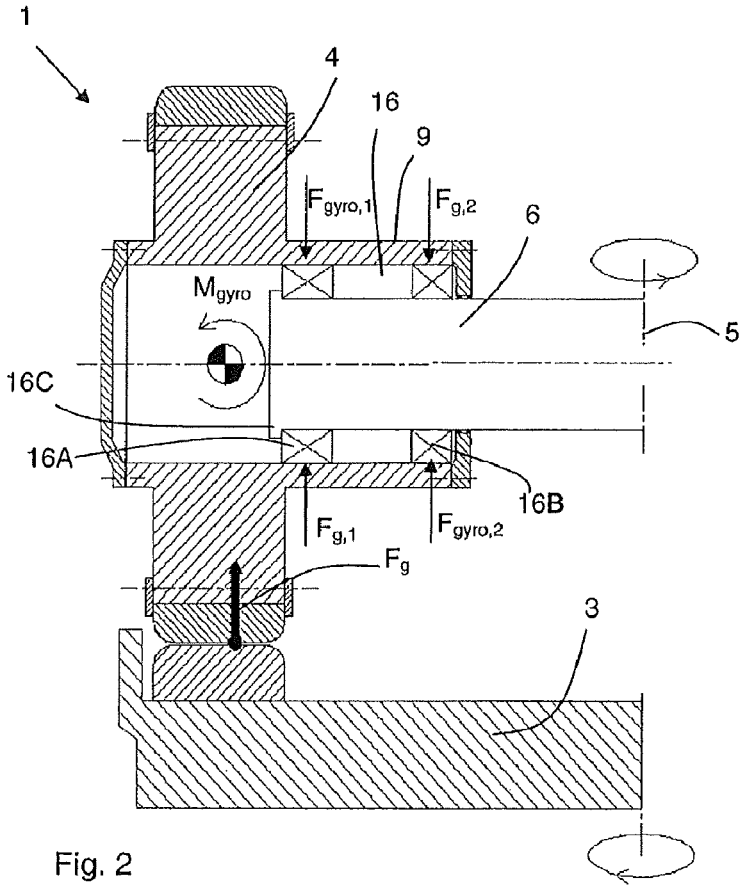
FIGS. 2 and 3 show two embodiment examples of a roller mill according to the invention.
Figure 3:
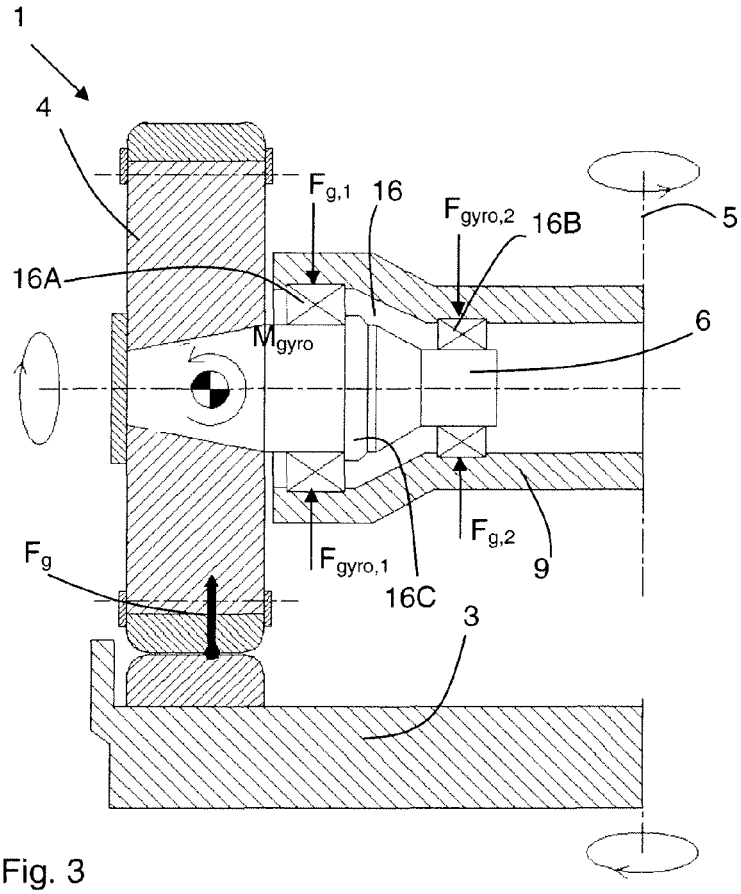
Figure 4:
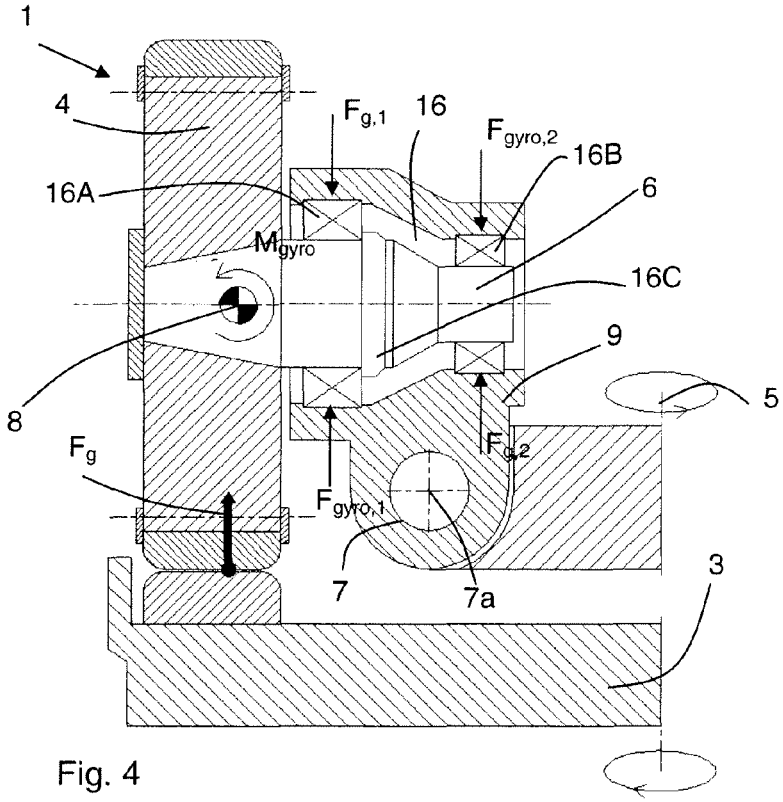
FIG. 4 shows a preferred embodiment of the roller mill according to the invention.

According to the invention, across its entire axial extent each roller bearing 16 is axially located within the resulting force $F_g$ acting upon the roller 4 from the grinding zone, thereby decreasing the load incurred by the entire bearing 16 and particularly the innermost part hereof since the forces of reaction from the gyro moment and the grinding force will have a partial and mutually neutralizing effect across the entire axial extent of the bearing in the manner shown in the FIGS. 2 to 4.

In the embodiment shown in FIG. 2, the roller shaft 6 is stationary as is the case in FIG. 1, being supported by means of a bearing 16 comprising two rolling bearings 16A and 16B. The embodiment shown in FIG. 2 is different from that shown in FIG. 1 in that the roller 4 is formed with a bearing housing 9 extending axially inward towards the vertical shaft 5 from the inner side of the roller 4. As a result hereof, both rolling bearings 16A and 16B can be axially fitted within the resulting force $F_g$ acting upon the roller 4. The roller shaft 6 also incorporates a flange 16C acting as an axial bearing face.

In the embodiment shown in FIG. 3 the roller shaft 6 is fixedly attached to the roller 4 and comprises a flange 16C which acts as an axial bearing face. A preferred embodiment of the invention is shown in FIG. 4. In this embodiment, each roller shaft 6 is connected to the vertical shaft 5 via a hinged connection 7 with a centre of rotation 7*a* allowing a free circular movement of the roller upward and downward in a plane comprising the centreline of the roller shaft. As a result, the gyro moment will contribute to the grinding force $F_g$ acting upon the particulate material. As in FIG. 3, the roller shaft is also fixedly attached to the roller 4 so that it turns simultaneously with the roller 4, thereby contributing to the grinding force generated by the gyro moment. The centre of rotation 7*a* of the hinged connection 7, viewed in a vertical plane, is also located under the horizontal plane which comprises the centre of mass 8 of the roller 4, the roller shaft 6 and the hinge part connected thereto so that the centrifugal force, which during the operation of the mill acts upon the roller 4, the roller shaft 4, the roller shaft 6 and the hinge part connected thereto, will also produce a turning moment about the hinge 7 and hence a downwardly directed contribution to the grinding force $F_g$.

While certain present preferred embodiments of a roller mill and methods of making and using the same have been shown and described above, it is to be distinctly understood that the invention is not limited thereto but may be otherwise variously embodied and practiced within the scope of the following claims.

The invention claimed is:

1. A roller mill for grinding material said roller mill comprising:

a substantially horizontal grinding table and a set of rollers revolving about a vertical shaft;

said set of rollers comprising a number of rollers rotatable about respective roller axes and each of the rollers being connected to the vertical shaft via a connection assembly comprising a roller bearing adjacent a roller shaft; and said set of rollers being configured for interactive operation with the grinding table for application of pressure to the material; and each roller bearing across its entire axial extent being axially located radially towards the vertical shaft and inwardly of a location of force from a grinding zone imposed upon the respective roller.

2. The roller mill according to claim 1, wherein the roller bearing is comprised of a bearing housing comprising at least two rolling bearings.

3. The roller mill according to claim 2, wherein the roller bearing further comprising an axial bearing.

4. The roller mill according to claim 1, wherein each roller shaft has a centerline and is connected to the vertical shaft via a hinged connection with a center of rotation allowing a free arcuate movement in an upward and downward direction in a plane including the centerline of the roller shaft.

5. The roller mill according to claim 4, wherein a center of rotation of the hinged connection in a vertical plane is located under the horizontal plane which comprises a center of mass of the roller, roller shaft and the hinged connection.

6. The roller mill according to claim 1 wherein the roller shaft is fixedly attached to the roller.

7. The roller mill according to claim 1, wherein the roller 5 shaft for each roller is substantially horizontal.

8. The roller mill of claim 1 wherein the roller shaft for each roller has an inclination between 0° and 45° to the horizontal level.

9. The roller mill according to claim 1 wherein each roller bearing is located between a respective roller and the vertical shaft.

10. The roller mill of claim 1 wherein the material is particulate material, cement raw materials, cement clinker, or coal.

11. A roller mill comprising:

a grinding table defining a substantially horizontal grinding surface;

a vertical shaft positioned adjacent to the grinding table, a plurality of rollers connected to the vertical shaft, the rollers being rotatable adjacent the horizontal grinding surface, each of the rollers being connected to the vertical shaft via a respective connection assembly comprised of at least one bearing adjacent the roller;

each roller being sized and configured to for interactive operation with the grinding table to apply pressure to material in a grinding zone; and the at least one bearing comprised of at least one roller bearing axially located radially towards the vertical shaft and inwardly of a location of force from the grinding zone imposed upon the roller to which that roller bearing is adjacent such that the roller bearing is between the roller to which the roller bearing is adjacent and the vertical shaft.

12. The roller mill of claim 11 wherein an entire length of each roller bearing is axially located radially towards the vertical shaft and inwardly of a location of force from the grinding zone imposed upon the roller to which that roller bearing is connected.

13. The roller mill of claim 11 wherein an entire axial extent of each roller bearing is axially located radially towards the vertical shaft and inwardly of a location of force from the grinding zone imposed upon the roller to which that roller bearing is connected.

14. The roller mill of claim 11 wherein each roller bearing is comprised of a bearing housing and at least two rolling bearings.

15. The roller mill of claim 11 wherein the connection assembly is also comprised of a roller shaft connected between the at least one bearing and the vertical shaft.

16. The roller mill of claim 15 wherein each roller shaft is connected to the vertical shaft via a hinged connection with a center of rotation allowing a free arcuate movement in an upward direction and a downward direction in a plane including a centerline of the roller shaft.

17. The roller mill of claim 16 wherein the rollers, roller shaft, and hinged connection define a center of mass and a center of rotation for the hinged connection is in a vertical plane located under a horizontal plane that passes through the center of mass or includes the center of mass.

18. The roller mill of claim 16 wherein the rollers, roller shaft, and hinged connection define a center of mass and a center of rotation for the hinged connection is in a substantially vertical plane located under a substantially horizontal plane that passes through the center of mass or includes the center of mass.

19. The roller mill of claim 11 wherein the connection assembly comprises a roller shaft for connecting a respective one of the rollers to the vertical shaft, and wherein each of the roller bearings is positioned adjacent the roller shaft such that an entire length of each roller bearing is located between the vertical shaft and the roller to which the roller shaft is connected.

20. The roller mill of claim 1 wherein each roller shaft has an axial length extending from the vertical shaft to one of the rollers to which that roller shaft is connected; and wherein each roller bearing is adjacent to a respective one of the roller shafts and the roller connected to that respective one of the roller shafts; and wherein the entire axial extent of each roller bearing is an entire length of the roller bearing and that entire length of the roller bearing extends along a portion of the axial length of the roller shaft to which that roller bearing is adjacent and is located between the roller adjacent that roller bearing and the vertical shaft.

* * * * *